US011565918B2

(12) United States Patent
Lykkegaard

(10) Patent No.: US 11,565,918 B2
(45) Date of Patent: Jan. 31, 2023

(54) SCISSORS LIFT FOR A WHEELCHAIR

(71) Applicant: Pride Mobility Products Corporation, Exeter, PA (US)

(72) Inventor: Frank Lykkegaard, Åbyhøj (DK)

(73) Assignee: Pride Mobility Products Corporation, Exeter, PA (US)

( * ) Notice: Subject to any disclaimer, the term of this patent is extended or adjusted under 35 U.S.C. 154(b) by 215 days.

(21) Appl. No.: 17/062,206

(22) Filed: Oct. 2, 2020

(65) Prior Publication Data

US 2021/0061628 A1 Mar. 4, 2021

Related U.S. Application Data

(63) Continuation of application No. 16/312,574, filed as application No. PCT/DK2017/050224 on Jul. 4, 2017, now Pat. No. 10,793,406.

(30) Foreign Application Priority Data

Jul. 5, 2016 (DK) ..... PA201670490

(51) Int. Cl.
*B66F 3/22* (2006.01)
*A61G 5/10* (2006.01)

(52) U.S. Cl.
CPC ..... *B66F 3/22* (2013.01); *A61G 5/104* (2013.01); *A61G 5/1059* (2013.01)

(58) Field of Classification Search
CPC ..... B66F 7/00; B66F 7/065; B66F 7/0658; B66F 7/0666; B66F 7/675
See application file for complete search history.

(56) References Cited

U.S. PATENT DOCUMENTS 3,621,940 A * 11/1971 Lodige ..... B66F 7/08 187/269
4,403,680 A * 9/1983 Hillesheimer ..... B66F 17/00 187/269

(Continued)

FOREIGN PATENT DOCUMENTS

CN 1749152 A 3/2006
CN 201597195 A 10/2010

(Continued)

OTHER PUBLICATIONS

Examination Report No. 1 for Australian Patent Application No. 2017294290 dated Apr. 11, 2019, 3 pages.

(Continued)

*Primary Examiner* — Lee D Wilson
(74) *Attorney, Agent, or Firm* — Morgan, Lewis & Bockius LLP

(57) ABSTRACT

The present invention relates to a scissors lift comprising a bottom frame, a top frame and a scissors mechanism arranged between said bottom frame and said top frame to displace said bottom frame and said top frame relative to each other by transfer of an actuation force. The scissors mechanism comprises a central hollow scissors arm delimited between opposite scissors arm surfaces, wherein said central hollow scissors arm has a bottom pivotal connection connecting it to said bottom frame and a top pivotal connection connecting it to said top frame. Further, the mechanism comprises two passive scissors arms being pivotally connected to said bottom frame and pivotally connected to said top frame. Each of said two passive scissors arms are pivotally connected to said central hollow scissors arm on said opposite scissors arm surfaces of said central hollow scissors arm. Further, the scissors lift comprises a motor providing said actuation force, said motor located between said opposite scissors arm surfaces of said central hollow (Continued)

scissors arm. Thereby, the motor may be protected and at least partially enclosed by the scissors lift and even by the central hollow scissors arm, allowing a safer and/or more easily maintained scissors lift.

12 Claims, 4 Drawing Sheets

(56) References Cited

U.S. PATENT DOCUMENTS

| | | | | |
|---|---|---|---|---|
| 4,582,310 | A | 4/1986 | Hahn | |
| 5,016,858 | A * | 5/1991 | Mitchell | B66F 7/065 296/26.07 |
| 5,033,717 | A | 7/1991 | Symon | |
| 5,058,871 | A | 10/1991 | Congin et al. | |
| 5,131,628 | A | 7/1992 | Huang | |
| 5,161,782 | A | 11/1992 | Huang | |
| 6,601,826 | B1 * | 8/2003 | Granata | F16H 21/04 254/122 |
| 2003/0150657 | A1 * | 8/2003 | Shupp | B60T 7/16 180/168 |
| 2005/0092975 | A1 | 5/2005 | Tarra | |
| 2006/0249716 | A1 | 11/2006 | Rincoe | |
| 2007/0084648 | A1 * | 4/2007 | DuFresne | A61G 5/1059 180/907 |
| 2010/0243973 | A1 | 9/2010 | Deuring et al. | |
| 2010/0257671 | A1 | 10/2010 | Shimada et al. | |
| 2015/0283017 | A1 * | 10/2015 | Harris, Jr. | A61G 13/10 5/611 |
| 2019/0322502 | A1 | 10/2019 | Lykkegaard | |
| 2021/0061628 | A1 * | 3/2021 | Lykkegaard | A61G 5/104 |

FOREIGN PATENT DOCUMENTS

| | | | |
|---|---|---|---|
| CN | 103332633 | A | 10/2013 |
| CN | 103508372 | A | 1/2014 |
| CN | 204714451 | A | 10/2015 |
| EP | 1384697 | A1 | 2/2004 |
| EP | 2676918 | A1 | 12/2013 |
| JP | 2001097680 | A | 4/2001 |
| WO | 1999062813 | A1 | 12/1999 |
| WO | 2010091027 | A2 | 8/2010 |
| WO | 2015031237 | A1 | 3/2015 |

OTHER PUBLICATIONS

Canadian Office Action for Canadian Patent Application No. 3029127 dated Feb. 5, 2020, 4 pages.
First Office Action for Chinese Patent Application No. 201780042046.1 dated Jan. 10, 2020, 26 pages.
Examination Report for Australian Patent Application No. 2017294290 dated Apr. 11, 2019, 3 pages.
International Search Report dated Oct. 10, 2017 for International Patent Application No. PCT/DK2017/050224, 4 pages.
Written Opinion for International Patent Application No. PCT/DK2017/050224, 6 pages.

* cited by examiner

SCISSORS LIFT FOR A WHEELCHAIR

CROSS REFERENCE TO RELATED APPLICATIONS

This application is a continuation of U.S. patent application Ser. No. 16/312,574 filed Dec. 21, 2018, which is a U.S. national stage of International Application No. PCT/DK2017/050224, filed Jul. 4, 2017, which claims the benefit of Danish Patent Application no. PA 2016 70490 filed Jul. 5, 2016 and entitled "Improved Scissors Lift for a Wheelchair", each of which is incorporated by reference herein in its entirety.

CROSS REFERENCE TO RELATED APPLICATIONS

This application is a continuation of U.S. patent application Ser. No. 16/312,574 filed Dec. 21, 2018, which is a U.S. national stage of International Application No. PCT/DK2017/050224, filed Jul. 4, 2017, which claims the benefit of Danish Patent Application no. PA 2016 70490 filed Jul. 5, 2016 and entitled "Improved Scissors Lift for a Wheelchair", each of which is incorporated by reference herein in its entirety.

FIELD OF THE INVENTION

The present invention relates to aids and appliances for disabled persons and more particularly to personal lifting systems. Further, the invention relates to lifting mechanisms based on a scissors lift mechanism with an integrated actuator.

DESCRIPTION OF PRIOR ART

Scissors lifts capable of lifting a load vertically are, among other uses, used as an aid for disabled persons in combination with eg a wheelchair for making face-to-face communication with a standing person, this being a psychological relief for many. Often, these lifts rely on a scissors mechanism of two arms linked in an "X"-pattern in combination with an actuator capable of manipulating these arms such that a platform is either raised or lowered. Typically, the actuator is either hydraulic, pneumatic, or mechanical. In the fully contracted state, the arms of the scissors are substantially parallel, exerting a force onto an arm that forces the arms to be raised, producing the X-pattern.

A problem with scissors lifts is that the power use over the stroke of opening or closing the scissors lift is very uneven, where the initial opening of the scissors requires significantly more power than the rest of the stroke. This leads to a need for a motor that is able to open the scissors lift, said motor thus being over-dimensioned for the rest of its operating range. Further, large stresses are exerted on lift components such as joints. A large motor is disadvantageous in wheelchairs, where a more powerful motor increases power consumption and reduces the time between refueling/recharging. This also leads to the motor being heavy, taking up more space in the wheelchair and being more complicated and thus more prone to fail, difficult to maintain and with more openings where dirt can enter the machinery.

US2006/0087166A1 discloses a screw system in the bottom frame of the lift, to which the arms are mounted such that a rotation of the screw, eg by the use of a motor, either reduces or extends the distance between the ends of the arms, resulting in a lifting or a lowering of the platform, respectively. However, an oiled thread is exposed on the bottom frame to allow such movement, vulnerable to a buildup of dirt, being difficult to maintain and posing a risk of getting something that falls into the scissors lift stuck, broken or lost due to the high torque of the screw.

EP2676918A1 discloses a scissors lift comprising a lever mechanism connected to a linear actuator and one point of attack on one of the arms and another on the bottom frame of the lift, and where a linear actuator is attached to the base of the bottom frame. However, dirt easily gets into eg the actuator while the mechanism is a danger to a user since the actuator is exposed and is further rotatable.

The present invention provides a solution to some of the above-mentioned problems.

SUMMARY OF THE INVENTION

In accordance with the invention, a scissors lift is provided comprising a bottom frame, a top frame and a scissors mechanism arranged between said bottom frame and said top frame to displace said bottom frame and said top frame relative to each other by transfer of an actuation force. The scissors mechanism comprises a central hollow scissors arm delimited between opposite scissors arm surfaces, wherein said central hollow scissors arm has a bottom pivotal connection connecting it to said bottom frame and a top pivotal connection connecting it to said top frame. Further, the mechanism comprises two passive scissors arms being pivotally connected to said bottom frame and pivotally connected to said top frame. Each of said two passive scissors arms are pivotally connected to said central hollow scissors arm on said opposite scissors arm surfaces of said central hollow scissors arm. Further, the scissors lift comprises a motor providing said actuation force, said motor located between said opposite scissors arm surfaces of said central hollow scissors arm.

Thereby, the motor may be protected and at least partially enclosed by the scissors lift and even by the central hollow scissors arm, allowing a safer and/or more easily maintained scissors lift. Thereby, the scissors lift allows lifting with only the three arms in total, as the second passive scissors arm stabilises the lift structurally to ensure that it does not tilt to either side or put undue stresses on joints during operation.

By hollow is to be understood that within the arm delimited between opposite scissors arm surfaces is a space allowing the placement of a motor. In an embodiment, the central hollow scissors arm may be a closed rectangular or rounded pipe (opposite scissors arm surfaces connected at both ends), or it may be a U-profile. In another embodiment, it may be an H-shaped profile or even two sheets interconnected via connecting elements. The material between opposite scissors arm surfaces functions as a cover for protecting the motor below the surface against liquid. The motor could be positioned either inside the hollow scissors arm or below the hollow scissors arm.

By transfer of an actuation force is to be understood that an actual force is provided by a motor and that by a stroke mechanism, this actuation force is transferred into a displacement of the two frames. The motor may be any convenient type of motor transferring electrical energy into mechanical energy. The type of mechanical energy useful is dictated by the specific stroke mechanism employed and is conveniently rotational movement or axial movement. A linear actuator such as a mechanical actuator, a hydraulic actuator, a pneumatic actuator, or electro-mechanical actuators may conveniently provide axial movement. A stepper motor, a servo motor or another type of motor may conveniently provide rotary motion.

The motor is retained inside or under the central hollow scissors arm, whereby when the scissors mechanism is in a closed state, the motor takes up space inside the central hollow scissors arm. Thereby, in a closed state the motor is substantially protected by the scissors mechanism and the central hollow scissors arm.

By bottom frame and top frame is to be understood two surfaces or elements displaceable by the scissors lift. Either frame may take any position in use, whereby the top frame may be the uppermost of the two frames. Further, the top frame may be the lowermost of the two frames. At least, this means that the motor may be retained above the central hollow scissors arm or next to the central hollow scissors arm.

In an embodiment, the scissors lift further comprises a stroke mechanism for transferring said actuation force into displacing said bottom frame and said top frame relative to each other, said stroke mechanism comprising a lever, the lever comprises a body comprising an actuation joint being displaceable by said actuation force, and a fulcrum joint connecting said lever body to said bottom frame or said central hollow scissors arm. Further, the lever comprises a load joint connected to the body through a load element, said load joint connecting said lever to said central hollow scissors arm or said bottom frame. The lever then has a lever distance from the fulcrum joint to the actuation joint, and a load distance from the fulcrum joint to the load joint, wherein the stroke mechanism enables a stroke, where the stroke is from a substantially closed state of said scissors lift.

Further, the stroke at least initially decreases said lever distance and/or increases said load distance. Thereby the leverage provided by the lever for the stroke mechanism changes during displacing the frames, being greatest in the initial duration of the stroke, where the stroke is the most difficult. This ensures that the effective actuation force needed to displace the frames may be at least more uniform during the stroke, further allowing using a smaller motor for actuating the scissors lift, a smaller motor being cheaper to acquire, less energy-intensive, cheaper and more convenient in use, and easier to maintain. Further, this smaller motor is better adapted to be inserted into the central hollow scissors arm, and further, by modifying the lever distance and/or the load distance during the stroke, the whole size/breadth/height of the central hollow arm may be utilized throughout the stroke.

The load element is an element guiding the transfer of force between the lever and the load joint and may take different shapes. For example, it may be a hollow guide where the load joint is situated inside and forced to follow a movement herein. Alternatively, it may be an arm joined pivotally to the body of the lever.

In an embodiment, the changing lever geometry substantially approximates the difference in power needed, whereby the needed actuation force is substantially even during at least the first half of the stroke.

By initial length of a stroke is to be understood at least the initial length of a stroke from a substantially closed state, from where the scissors mechanism is initially in its most compact state. In this closed state, the two frames are the closest to each other possible within their mechanical freedom afforded by the scissors lift. The entire movement from a closed state to an open state of the scissors lift is called a stroke. When referring to the stroke, it may also refer to the opposite movement, from a state to a comparatively more closed state. However, by the term initial stroke is to be understood as mentioned, an initial length of the stroke from a substantially closed state. In an embodiment of the invention, this stroke refers to the initial 5% of the travel distance, to the initial 10% of the travel distance, to the initial 20% of the travel distance, to the initial 30% of the travel distance, to the initial 40% of the travel distance or even to the initial 50% of the travel distance, from a state where the scissors mechanism is initially in its most compact state.

In an embodiment of the invention, by thus changing the lever distance and/or the load distance during the stroke, the initial leverage may be provided by a lever employing the entire inside of the central hollow scissors arm, whereby a greater leverage may be provided while keeping the dimensions of the stroke mechanism small enough to retain at least substantially inside the central hollow scissors arm and/or while not putting undue stress on components of the stroke mechanism.

In an embodiment, at least initially, the stroke enables increasing the load distance and decreasing the lever distance.

In an embodiment, at least initially, the stroke enables increasing the load distance.

In an embodiment, at least initially, the stroke enables decreasing the lever distance.

In an embodiment, at least initially, the stroke decreases the leverage provided by the lever.

In an embodiment, the lever comprises a telescopic end enabling a shortening of said lever distance during at least an initial length of said stroke. Thereby, the leverage is greatest during the initial length of the stroke.

The telescopic end may be fastened to the end of the lever engaging the actuation joint. This allows the end of the telescopic arm to follow a linear line of action. Thereby, it may be driven by a motor arranged to be fixated to a frame or an arm, whereby the effective size of the motor is minimised, since it does not need to rotate to follow the lever. This also allows hiding the motor, e.g. in a central hollow scissors arm, shielding it from environmental wear and facilitating a simpler and safer design with less risk of a user getting fingers or hair stuck in the mechanism.

Further, by pivotally fixing the lever having a telescopic end to the central hollow scissors arm allows the stroke mechanism to be comprised in the arm while allowing the lever principle to work in favour of the invention. For example, by fixing the lever in one side of the central hollow scissors arm, the actuated element may engage it at the opposite side of the central hollow scissors arm, whereby substantially, the breadth of the arm becomes the lever.

Further, by having the lever engage the actuated element in the shape of a telescopic end, the lever is effectively longer at the beginning of the stroke when the power needed is the highest, whereby the transferred torque is higher for the initial stroke, where more force is needed.

In an embodiment, the lever comprises a curved guide, enabling a movement of said load joint away from said fulcrum joint during an initial length of said stroke, whereby said load distance is lengthened. Thereby, the mechanism may be very precisely formed to control the force needed during different stages of the stroke, thereby for example allowing the actuation force needed to be substantially even throughout a first half of the stroke or even the entire stroke.

In an embodiment, the load element comprises

- a knee joint whose position is fixed relative to said fulcrum joint and
- where the load element is connected to said knee joint and connected to said load joint, where the load element rotates around said knee joint and where this rotation enables lengthening the load distance during at least an initial length of said stroke.

Thereby, a high initial leverage may be provided where later stages of the stroke may have smaller leverages, whereby the motor may be smaller and therefore fit inside the central hollow arm.

In an embodiment, the three joints of the lever are arranged substantially in a V-shape with the knee joint mounted in one end, the fulcrum joint in the bottom centre, and the actuation joint in the end opposite the knee joint. The lengths of the legs may be different. The actual shape of the lever may also be different, as long as the position of the three joints are arranged substantially in a V-shape. Further, among the load joint and the knee joint, the load joint is provided closest to a line co-linear with the lever distance. A line passing through the load joint and the knee joint intersects the lever distance at least in a closed state of the scissors lift for a view perpendicular to the plane of the scissors arms. In a preferred embodiment, the load joint is provided closer to the fulcrum joint than the knee joint, which, in turn is provided closer to the fulcrum joint than the actuation joint during a substantially closed state. During a stroke, the load joint is brought away from said fulcrum joint.

Thereby, the lever principle, which requires rotating a lever over a fulcrum thus producing non-linear action, may be combined in a simple and efficient manner with a motor working at a low gearing and transferring power into axial movement or rotating a threaded rod.

In an embodiment, the lever comprises a telescopic end, whereby said stroke at least initially enables decreasing said lever distance and/or a curved guide guiding said load joint, enabling a movement of said load joint away from said fulcrum joint during at least an initial length of said stroke, whereby said stroke at least initially enables increasing said load distance and/or said load element comprises a knee joint whose position is fixed relative to said fulcrum joint and a load element connected to said knee joint and connected to said load joint, where the load element rotates around said knee joint and where this rotation enables lengthening the load distance during at least an initial length of said stroke. Thereby, the leverage provided by said lever decreases during an initial length of said stroke.

In an embodiment, the lever distance is provided at an angle to a distance going from said fulcrum joint to said knee-joint. Thereby, the lever is at an angle whereby transfer of forces by the stroke mechanism is more efficient.

In an embodiment of the invention, it relates to a wheelchair comprising a scissors lift according to the above.

Thereby, a wheelchair is provided having a safely operating scissors lift, which is easy to maintain with a motor protected and at least partially enclosed by the scissors lift and even by the central hollow scissors arm, allowing a safer and/or more easily maintained scissors lift.

In this aspect of the invention, the mentioned embodiments of the scissors lift can be applied to a wheelchair having a scissors lift as well.

LIST OF FIGURES

The scissors lift will be described in more detail below with references to exemplary embodiments shown in the figures wherein, FIG. 1A is a perspective view of a scissors lift according to the invention.

FIGS. 4A and 48 illustrates an embodiment using a guide according to the invention in a contracted and expanded configuration, respectively.

FIGS. 5A and 58 illustrates an embodiment using a knee-joint according to the invention in a contracted and expanded configuration, respectively.

GENERAL DESCRIPTION

Figure 1A:
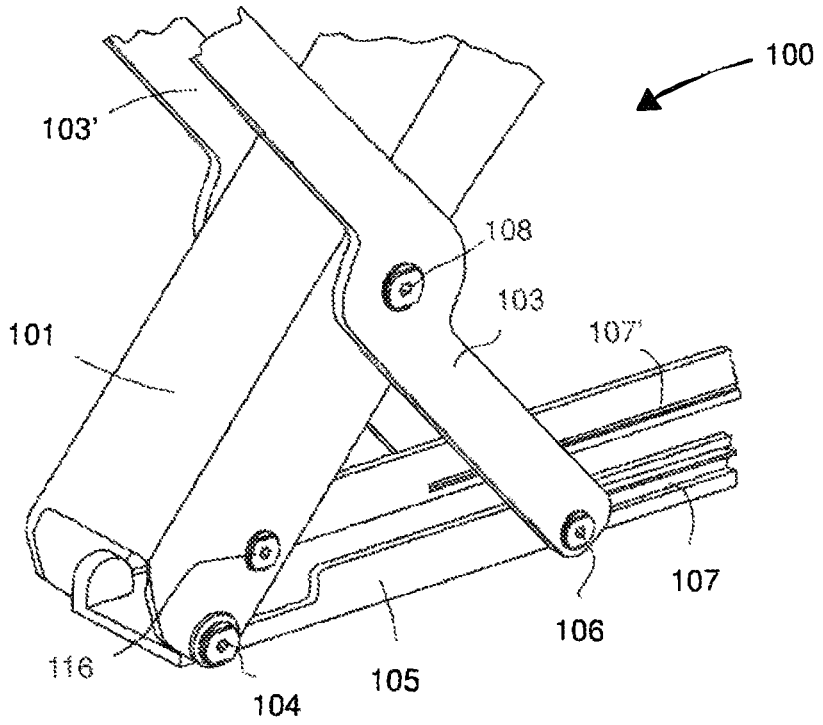
FIG. 1B illustrates a side view of a scissors lift according to the invention.

FIG. 1A is a perspective view of a scissors lift 100 according to the invention. A central hollow scissors arm 101 comprises the motor and a stroke mechanism not shown, flanked by two passive scissors arms 103 and 103' at opposite scissors arm surfaces. The scissors arms 101, 103, and 103' are pivotally connected at their mutual crossing through a scissors arms joint 108. The bottom frame 105 comprises a first pivot point 104 in one end of the frame. Said first pivot point 104 connects the central hollow scissors arm 101 to said bottom frame 105, whereas the passive scissors arms 103 and 103' are connected to the bottom frame through slidable bottom pivot points 106 and 106', which are mounted on displaceable elements along bottom rails 107 and 107'.

The bottom frame 105 is a rectangular profile, i.e. a profile having two parallel arms connected in their ends through two shorter elements perpendicular to said longer arms. The bottom frame 105 may also be a 'U'-shaped profile, comprising a connection between said parallels in only one end.

Figure 1B:
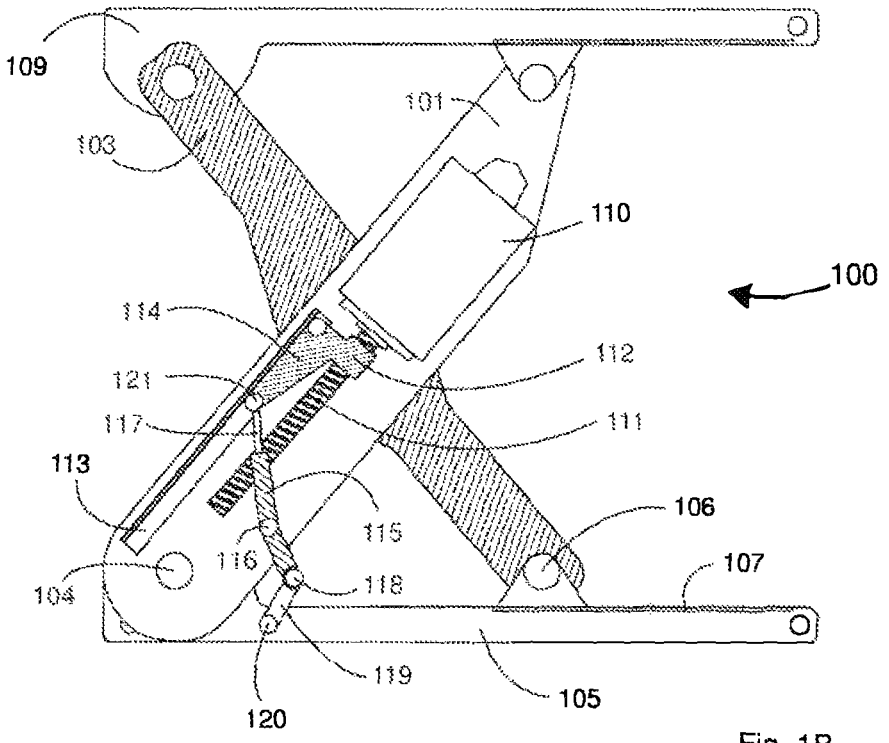

FIG. 1B is a side view of the scissors lift 100 according to the invention. The side view originates from a cut in between the two passive scissors arms 103, 103', in a direction parallel to the plane of the scissors arms 101, 103, and 103'. The central hollow scissors arm 101 houses a motor 110 and a stroke mechanism 111-120 for providing a stroke that lifts the top frame. The remaining two scissors arms 103, 103' are passive, such that their movement is determined through the movement of the central hollow scissors arm. A top frame 109 is shown in this embodiment, where the central hollow scissors arm 101 is pivotally connected to a displaceable element along the rails of the top frame 109, and the passive scissors arms 103 and 103' are connected to a fixed pivot point on the top frame 109.

A motor 110 is adapted to rotate a threaded rod 111, displacing a threaded engaging element 112 fixed to an actuated element 114 along a threaded rod. The actuated element 114 moves along an actuation rail 113, parallel to the central hollow scissors arm.

A lever 115 is pivotally connected to the central hollow scissors arm in a fulcrum joint 116, pivotally connected to the actuated element 114 through a telescopic end 117, and an knee joint 118 in an opposite, distal end.

The lever 115 slightly bends at the fulcrum joint 116 mounted on the central hollow scissors arm 101. Further, the lever 115 is connected to the bottom frame through a knee joint 118, mounted to a load element 119 connected to the bottom frame 105 through a load joint 120. The load element guides the transfer of force from said lever 115 to said load joint 120.

Figure 2A:
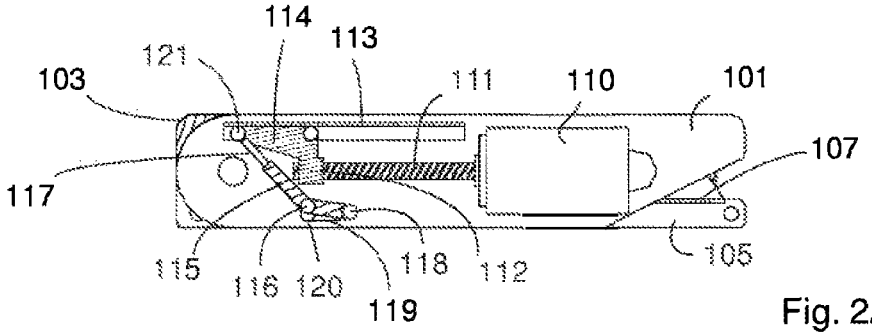
FIG. 2A-2D illustrates an opening procedure of a scissors lift according to the invention.

In FIG. 2A, the scissors lift is shown in a closed state. In this state, the threaded engaging element 112 and the actuated element 114 connected to said threaded engaging element 112 is furthest away from the motor 110. Thereby, the telescopic end 117 is extended to compensate for the longer distance between the fulcrum joint 116 on the central hollow scissors arm 101, and the actuation joint 121 of said telescopic end 117 to the actuated element 114. Further, the long distance between the two joints 116 and 121 of the telescopic end 117 allows for a greater leverage through the lever 115 in the beginning of the motion from a closed state to an open state. The knee joint-structure 118-120 is fully folded, and the bent nature of the lever 115 allows for a slimmer profile in a closed state.

Figure 2B:
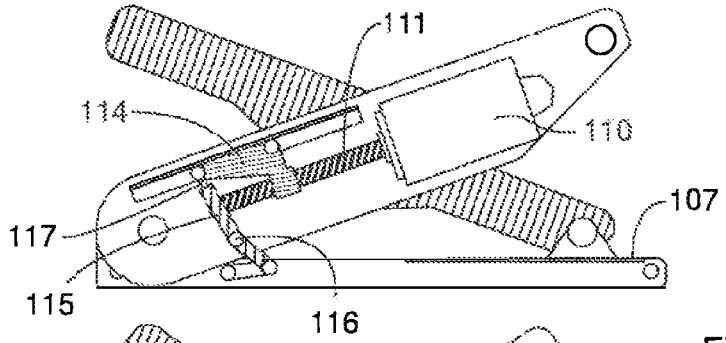

In FIG. 2B, the motor 110 has rotated the threaded rod 111, bringing the threaded engaging element 112, and thereby the actuated element 114, slightly closer to the motor 110. The telescopic end 117 is now retracted, to accommodate the decreased distance between the fulcrum joint 116 and the actuation joint 121. The movement of the actuated element 114 has rotated the lever 115, pushing against the knee joint, which cannot move further downwards, instead translating the force into causing the central hollow scissors arm 101 to be slightly raised through the fulcrum joint 116 connecting it to said lever 115, further displacing the frames relative to each other.

Figure 2C:
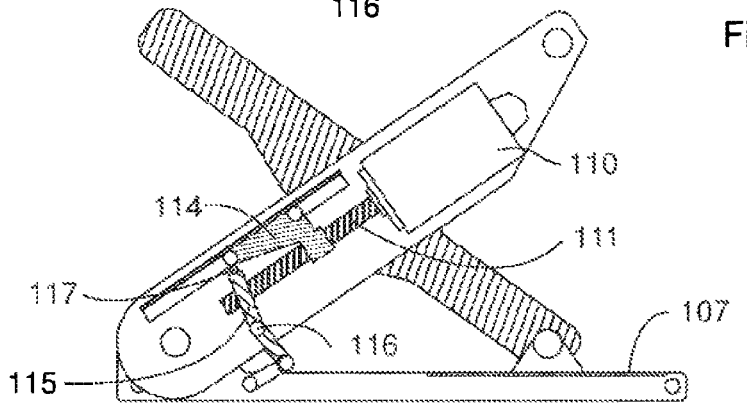

In FIG. 2C, the threaded engaging element 112 is even closer to the motor 110. The telescopic end 117 is still retracted, but the lever 115 has been pulled further upwards, through the actuation joint 121, executing a rotation in the fulcrum joint 116, further opening the knee-joint, thus putting a distance between the fulcrum joint 116 and the load joint 120, thereby lifting the central hollow scissors arm 101.

Figure 2D:
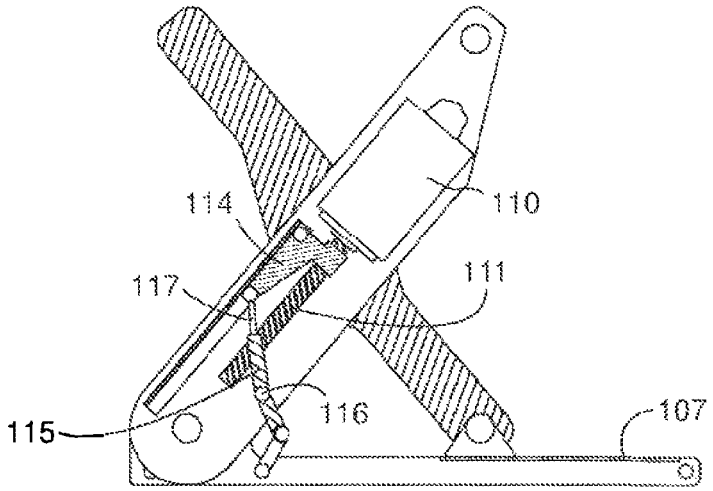

In FIG. 2D, the threaded engaging element 112 is as close to the motor 110 as mechanically allowed. Thereby, the actuated element 114 has pulled the telescopic end 117 to its maximum height, thereby executing a pull in the lever 115, such that said lever further executes a pull in the pivotal connection 116, connected to the central hollow scissors arm 101. Thereby, said scissors arm 101 has reached is maximum height, ie displaced the bottom frame 105 and the top frame from each other as much as is mechanically allowed. Through said scissors arms joint 108, the passive scissors arms 103 and 103' have likewise reached their maximum angle with respect to the bottom frame 105.

In all the above cases, the pull is supported through the knee joint-structure 118-120, connecting the stroke mechanism to the bottom frame 105 through the load joint 120. Further, in all the above cases, the passive scissors arms 103 and 103' have likewise increased their angle with respect to the bottom frame 105, as said passive scissors arms 103, 103' are pivotally connected to the central hollow scissors arm 101 through the scissors arms joint 108. The passive scissors arms 103, 103' are further able to move freely along the bottom rail 107 through slidable bottom joints 106, 106'.

Figure 3A:
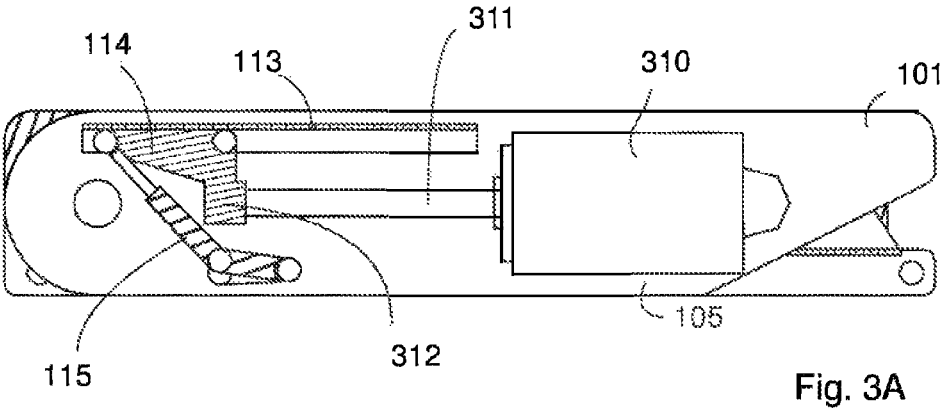
FIGS. 3A and 3B illustrates an alternative embodiment of a scissors lift according to the invention in a contracted and expanded configuration, respectively.
Figure 3B:
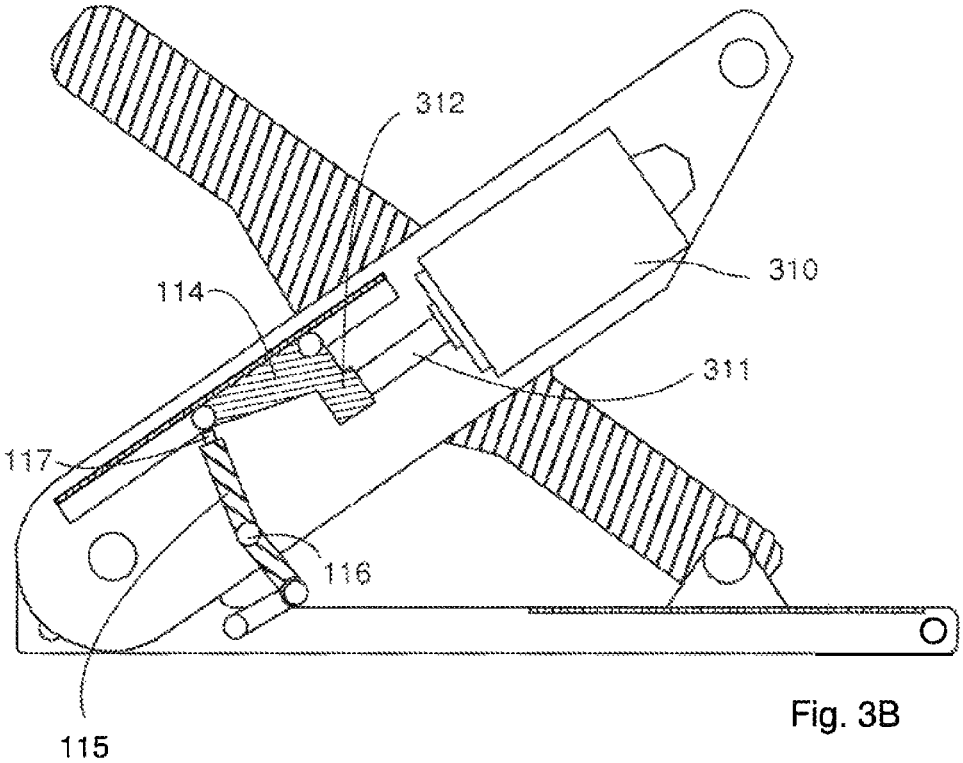

FIG. 3 shows another embodiment of a scissors lift according to the invention. The general construction is unchanged from the first embodiment, but the stroke mechanism is modified. A linear actuator 310 is adapted to extend or retract a rod 311. At the end of the rod 311, an element 312 is mounted and further connected to the actuated element 114, to which the stroke mechanism disclosed in the first embodiment applies and works likewise.

Figure 4A:
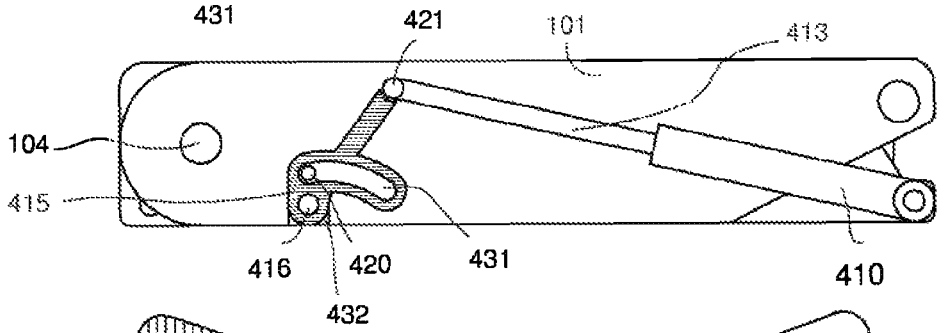
Figure 4B:
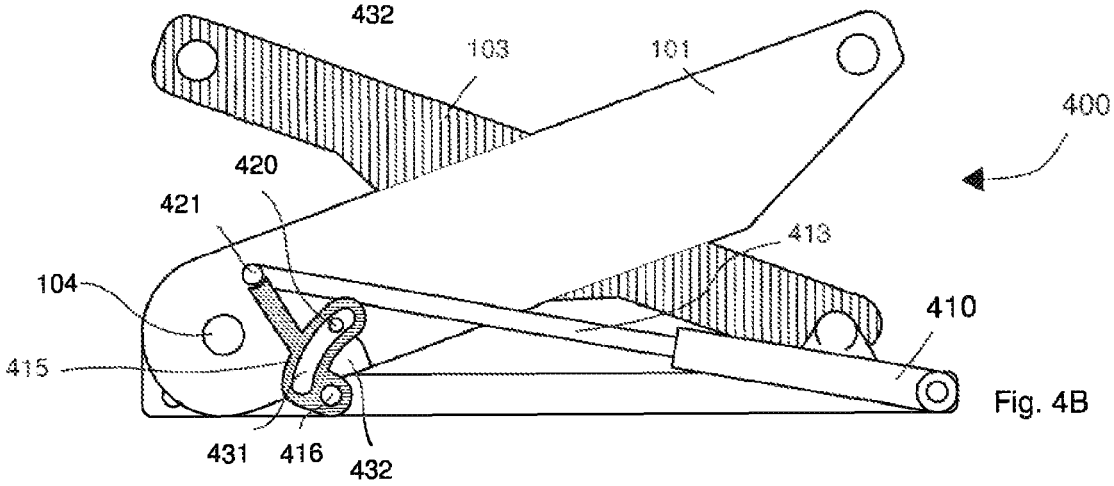

FIG. 4 shows another embodiment of a scissors lift 400 according to the invention. The general construction of the scissors lift 400 is similar to the first embodiment 100, but the stroke mechanism is different. In this embodiment, a linear actuator 410 is mounted to the bottom frame 105, and the actuator 410 provides a push through an actuator rod 411 connected at the actuation joint 421, to a lever 415. The lever element 415 comprises a load element being a guide 431, guiding the movement of a load joint 420 and fixating the movement of the lever around this load joint 420. Thereby, the load element 431 guides the translation of force from the lever 415 to the load joint 420.

The load joint 420 is fixed on the central hollow scissors arm 101, protruding into the load element 431, limiting the motion of the lever element 415 to the shape of said load element 431. The lever element 415 is pivotally connected to the bottom frame 105 through a fulcrum joint 416, such that a push provided by the actuator rod 411 causes the lever 415 to move along the load element 431, kept in place by the fulcrum joint 416, and by being further pivotally connected to the bottom frame 105, the push by the actuator rod 411 causes the lift to open by displacing the load joint 420 relative to the fulcrum joint 416, increasing the angle between the bottom frame and the scissors arms 101, 103, and 103'. A cavity 432 in the wall of the central hollow arm 101 is provided to allow access of the bottom frame for the fulcrum joint 416.

Figure 5A:
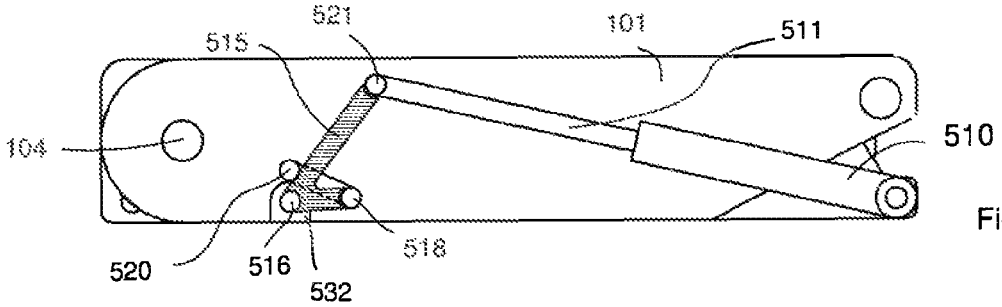
Figure 5B:
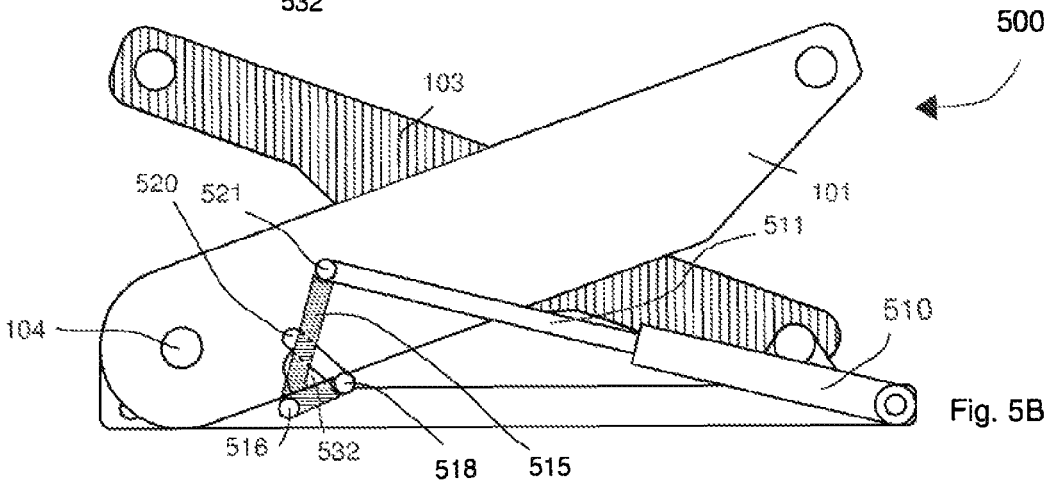

FIG. 5 shows another embodiment of a scissors lift 500 according to the invention. The general construction of the scissors lift 500 is similar to the first embodiment 100, but the stroke mechanism is different. In this embodiment, a linear actuator 510 is mounted to the bottom frame 105, being capable of providing a push or a pull through the actuation joint 521. The actuation joint 521 connects to a leg of a V-shaped lever 515. Further, the lever has a fulcrum joint 516 at a bend in the lever, around which the leverage of the motor rotates. A shorter leg is provided with a knee-joint. A load element 519 is connected between the knee joint 518 and a load joint 520 mounted on the central hollow scissors arm 101. When the linear actuator 510 extends the actuation rod 513, the rotation provided to the lever 515 causes its distal end to transfer the rotation through the knee joint 518 and onto the load joint 520 mounted on the central hollow scissors arm 101, finally causing the angle between the bottom frame and the scissors arms 101, 103, and 103' to increase. A cavity 532 in the wall of the central hollow arm 101 is provided to allow access of the bottom frame for the fulcrum joint 516.

The invention claimed is:

1. A scissor lift comprising:

a bottom frame;

a top frame; and a scissor mechanism arranged between the bottom frame and the top frame to displace the bottom frame and the top frame relative to each other, the scissor mechanism including:

a central scissor arm including at least one scissor arm surface, wherein the central scissor arm has a bottom pivotal connection connecting the central scissor arm to the bottom frame and a top pivotal connection connecting the central scissor arm to the top frame;

at least one passive scissor arm pivotally connected to the bottom frame and pivotally connected to the top frame, the at least one passive scissor arm pivotally connected to the central scissor arm on the at least one scissor arm surface;

a motor configured to displace the bottom frame and the top frame relative to each other, the motor located adjacent the at least one scissor arm surface; and an actuation element activatable by the motor to displace substantially along a longitudinal axis of the central scissor arm.

2. The scissor lift of claim 1, wherein the central scissor arm includes an U-shaped profile, wherein the at least one scissor arm surface includes a first surface and a second surface, and wherein the first surface and the second surface are interconnected at one end.

3. The scissor lift of claim 1, wherein the central scissor arm includes an U-shaped profile, wherein the at least one scissor arm surface includes a first surface and a second surface, and wherein the first surface and the second surface are interconnected at both ends.

4. The scissor lift of claim 1, further comprising:

a stroke mechanism coupled to the actuation element for transferring a force from the motor to displace the bottom frame and the top frame relative to each other, the stroke mechanism comprising:

a body;

an actuation joint being displaceable by the force from the motor, and a fulcrum joint connecting the body to the bottom frame or the central scissor arm;

a load joint connected to the body through a load element, the load joint connecting the stroke mechanism to the central scissor arm or the bottom frame, a lever distance from the fulcrum joint to the actuation joint, and a load distance, from the fulcrum joint to the load joint, wherein the stroke mechanism enables a stroke, the stroke being from a substantially closed state of the scissor lift, wherein the stroke at least initially decreases the lever distance and/or increases the load distance.

5. The scissor lift of claim 4, wherein the stroke at least initially enables increasing the load distance.

6. The scissor lift of claim 4, wherein the stroke at least initially enables decreasing the lever distance.

7. The scissor lift of claim 4, wherein the stroke mechanism comprises a telescopic end, whereby the stroke at least initially enables decreasing the lever distance.

8. The scissor lift of claim 4, wherein the stroke mechanism comprises a curved guide guiding the load joint, enabling a movement of the load joint away from the fulcrum joint at least initially during the stroke, whereby the stroke at least initially enables increasing the load distance.

9. The scissor lift of claim 4, wherein the load element comprises:

the load joint whose position is fixed relative to the fulcrum joint, and wherein the load element is connected to a knee joint and connected to the load joint, where s leg element rotates around the knee joint and where this rotation enables lengthening the load distance during at least an initial length of the stroke.

10. A wheelchair comprising a scissor lift:

the scissor lift comprising:

a bottom frame;

a top frame; and a scissor mechanism arranged between the bottom frame and the top frame to displace the bottom frame and the top frame relative to each other, the scissor mechanism including:

a central scissor arm including at least one scissor arm surface, wherein the central scissor arm has a bottom pivotal connection connecting the central scissor arm to the bottom frame and a top pivotal connection connecting the central scissor arm to the top frame;

at least one passive scissor arm pivotally connected to the bottom frame and pivotally connected to the top frame, the at least one passive scissor arm pivotally connected to the central scissor arm on the at least one scissor arm surface;

a motor configured to displace the bottom frame and the top frame relative to each other, the motor fixed to the at least one scissor arm surface; and an actuation element activatable by the motor to displace substantially along a longitudinal axis of the central scissor arm.

11. The scissor lift of claim 1, wherein the central scissor arm includes a channel configured to receive at least a portion of the motor.

12. The scissor lift of claim 1, wherein the motor moves relative to the bottom frame as the central scissor arm moves relative to the bottom frame.

* * * * *